US007948187B2

(12) United States Patent
Greening et al.

(10) Patent No.: US 7,948,187 B2
(45) Date of Patent: May 24, 2011

(54) ELECTRONICALLY CONTROLLING ACOUSTIC ENERGY FROM PIEZOELECTRIC TRANSFORMERS

(75) Inventors: Thomas C. Greening, Los Gatos, CA (US); William C. Athas, San Jose, CA (US)

(73) Assignee: Apple Inc., Cupertino, CA (US)

( * ) Notice: Subject to any disclaimer, the term of this patent is extended or adjusted under 35 U.S.C. 154(b) by 997 days.

(21) Appl. No.: 11/805,502

(22) Filed: May 22, 2007

(65) Prior Publication Data

US 2008/0290813 A1 Nov. 27, 2008

(51) Int. Cl.
*H05B 37/02* (2006.01)

(52) U.S. Cl. ..... 315/209 PZ; 315/209 R; 315/224; 315/246; 315/274

(58) Field of Classification Search ..... 323/282, 323/109; 315/209 PZ, 209 R, 224, 225, 246, 315/274–289
See application file for complete search history.

(56) References Cited

U.S. PATENT DOCUMENTS 4,056,786 A * 11/1977 Morrison et al. ..... 330/207 A
5,747,914 A * 5/1998 Huang et al. ..... 310/318
2007/0019935 A1 * 1/2007 Hsieh et al. ..... 388/811

* cited by examiner

*Primary Examiner* — Tuyet Thi Vo
(74) *Attorney, Agent, or Firm* — Park, Vaughan, Fleming & Dowler LLP; Steven E. Stupp

(57) ABSTRACT

A power-supply circuit is described. In particular, the power-supply circuit includes an input node configured to receive a power-supply signal, an output node configured to output a modulated power-supply signal, and a modulation mechanism coupled between the input node and the output node. This modulation mechanism is configured to modulate the power-supply signal to produce the modulated power-supply signal. Furthermore, the modulation mechanism may be configured to modulate the power-supply signal using both a first modulation and a second modulation. This first modulation is a duty-cycle modulation which controls the power output of the piezoelectric transformer signal, and the second modulation spreads harmonic energy associated with the first modulation over a range of frequencies. By spreading the harmonic energy, the perceived acoustical noise generated by the piezoelectric transformer is reduced.

23 Claims, 8 Drawing Sheets

ELECTRONICALLY CONTROLLING ACOUSTIC ENERGY FROM PIEZOELECTRIC TRANSFORMERS

BACKGROUND

1. Field of the Invention

The present invention relates to techniques for modulating power signals. More specifically, the present invention relates to circuits and methods for reducing the perceived acoustic energy produced by piezoelectric transformers.

2. Related Art

Compact electronic displays, such as liquid crystal displays (LCDs), are increasingly popular components in a wide variety of applications. Due to their low cost and good performance, these devices are now used extensively in portable electronic devices, such as laptop computers.

Many of these LCDs are illuminated using fluorescent light sources. For example, LCDs are often backlit by Cold Cathode Fluorescent Lamps (CCFLs) that are located above, behind, and/or beside the display. However, high-voltage power is needed to ionize atoms in fluorescent tubes. This high-voltage power can be provided by piezoelectric transformers.

A piezoelectric transformer generates an AC-output voltage having an amplitude on the order of 1000 V. This is accomplished by applying an AC-input voltage to the piezoelectric transformer. This applied voltage has a frequency near a resonant frequency of the piezoelectric transformer (around 50 kHz) and causes mechanical oscillations in the piezoelectric transformer which amplify the input voltage. Furthermore, the input voltage may be duty-cycle modulated (for example, using pulse-width modulation) in order to adjust the brightness of the display. Note that the pulse-width modulation may have a frequency of 200 Hz, thereby avoiding flicker and resonance with the refresh rate of the display.

Unfortunately, mixing occurs between the resonant frequency and the modulation frequency of the piezoelectric transformer. This modulation gives rise to intermodulation products over a broad range of frequencies including audible frequencies. Depending on the display brightness (i.e., on the amount of modulation) and the mechanical assembly of the piezoelectric transformer, the piezoelectric transformer may act as a speaker, producing tones that users can hear. This sound may be disturbing to the users and may result in a less favorable user experience when using the electronic device. Furthermore, attempting to reduce this sound by mechanically constraining the piezoelectric transformer may be self-defeating because this may reduce the amplification provided by the piezoelectric transformer.

Hence what is needed is a method and an apparatus that facilitates generating power in a piezoelectric transformer without the above-described problems.

SUMMARY

One embodiment of the present invention provides a power-supply circuit that includes an input node configured to receive a power-supply signal, an output node configured to output a modulated power-supply signal, and a modulation mechanism coupled between the input node and the output node. This mechanism may be configured to modulate the power-supply signal to produce the modulated power-supply signal. Furthermore, the modulation mechanism may be configured to modulate the power-supply signal using both a first modulation and a second modulation. This first modulation is a duty-cycle modulation which controls the power output of the power-supply signal, and the second modulation spreads harmonic energy associated with the first modulation over a range of frequencies.

In some embodiments, the duty cycle in the first modulation determines an average light intensity of a light source coupled to the power-supply circuit. For example, the light source may be a fluorescent lamp.

In some embodiments, the power-supply circuit is included in a computing device, which includes a display that is configured to be illuminated by the light source.

In some embodiments, the power-supply signal is associated with a piezoelectric transformer.

In some embodiments, the second modulation includes frequency modulation, pulse-time modulation, and/or phase modulation. For example, the second modulation may include pulse-width modulation. Note that a pulse-width period of the second modulation may be pseudorandomly varied.

In some embodiments, the second modulation uses a sequence of pulse-width modulated signals during a corresponding sequence of time intervals. Note that a given pulse-width modulated signal during a given time interval in the sequence of time intervals may have a pulse-width period that is determined using a pseudorandom sequence. In some embodiments, the modulation during the given time interval has the same duty cycle as in the duty-cycle modulation. Furthermore, in some embodiments the pulse-width period is determined to avoid interfering with a refresh frequency of the display that is configured to be illuminated by the light source. And in some embodiments the duty cycle is adjusted at low brightness levels to compensate for the impact of transformer ringing (or other circuit inefficiencies) on the display brightness.

In some embodiments, the second modulation reduces perception of sound associated with modulation of the power-supply signal using the first modulation.

In some embodiments, the second modulation is based on a look-up table.

In some embodiments, the second modulation is modified during a calibration mode. However, in some embodiments the second modulation is dynamically adjusted. Note that the modification may be based on a measured acoustic signal and/or a mechanical transfer function.

Another embodiment provides a computing system, including a power supply, a light source coupled to the power supply, and a display configured to be illuminated by the light source. The power supply may include the power supply circuit.

Another embodiment provides a method for generating the power-supply signal. During the method, the duty cycle of the power-supply signal is set using the first modulation to modulate the power-supply signal. Then, the second modulation is used to spread harmonic energy associated with the first modulation over a range of frequencies.

BRIEF DESCRIPTION OF THE FIGURES

Note that like reference numerals refer to corresponding parts throughout the drawings.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Embodiments of a circuit, a method, and a computer system that includes the circuit are described. These circuits, systems, and/or processes may be used to generate a power-supply signal. In particular, the circuit may be used to apply an additional modulation to a duty-cycle-modulated power-supply signal to spread harmonic energy associated with the duty-cycle modulation over a range of frequencies. The resulting modulated power-supply signal may be coupled to a piezoelectric transformer, which in turn may drive a light source, such as a fluorescent lamp. This light source may be used to illuminate a display in an electronic device.

The duty-cycle modulation in the power-supply signal may be used to set an average intensity or brightness of the light source. Furthermore, the additional modulation of the power-supply signal may reduce perception of sound associated with the duty-cycle modulation of the power-supply signal. Note that the additional modulation may include frequency modulation, pulse-time modulation, and/or phase modulation.

The electronic device may include a personal computer, a laptop computer, a cellular telephone, a personal digital assistant, an MP3 player, and/or another device that includes a piezoelectric transformer or, more generally, that includes a switched-mode power supply.

Figure 1A:
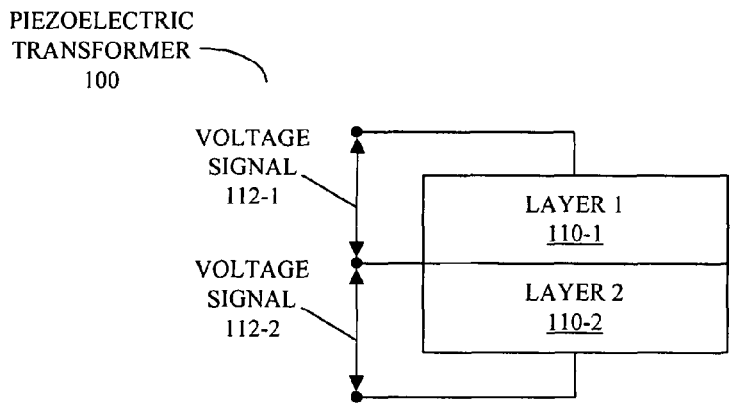
FIG. 1A is a block diagram illustrating a piezoelectric transformer in accordance with an embodiment of the present invention.
Figure 1B:
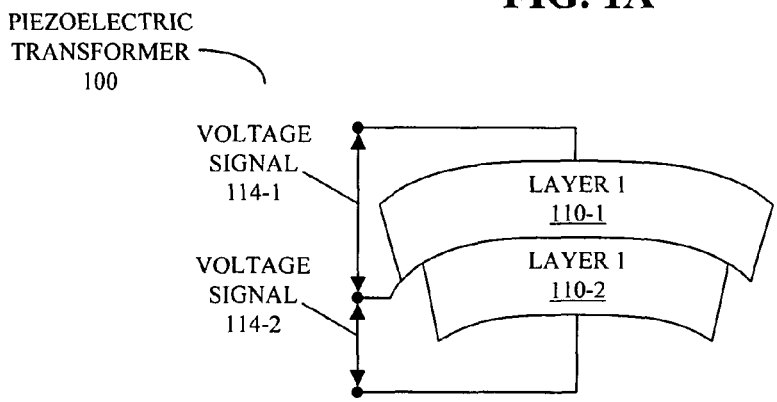
FIG. 1B is a block diagram illustrating a piezoelectric transformer in accordance with an embodiment of the present invention.

We now describe embodiments of a power-supply circuit for generating a power-supply signal. FIGS. 1A and 1B present block diagrams illustrating a piezoelectric transformer 100 in accordance with an embodiment of the present invention. This transformer includes a stack of piezoelectric layers 110, which each have a net electric polarization. When voltage signals 112 of 0 V are applied to the inputs to the piezoelectric transformer 100, the layers 110 are undistorted. However, when voltage signals 114 (such as sine-wave or square-wave signals) having a fundamental frequency near the resonant frequency of the piezoelectric transformer 100 (which is henceforth referred to as the 'resonant frequency'), which is typically about 50 kHz depending on transformer geometry, are applied to the piezoelectric transformer 100, a mechanical oscillation occurs in the layers 110.

In particular, during a first half-period the applied voltage signals 114 decrease the thickness and increase the length of layer 110-1, and increase the thickness and decrease the length of layer 110-2. The process is reversed during a second half-period of the voltage signals 114. The resulting mechanical distortion is converted into electrical energy on an output (not shown) via the piezoelectric effect. Furthermore, due to the shape of the layers 110 distortion along a first symmetry axis of the layers 110 gives rise to a larger distortion, and thus amplification, along a second symmetry axis of the layers 110. Note that in some embodiments the piezoelectric transformer 100 has a gain of 100.

As discussed previously, the voltage signals 114 are often duty-cycle modulated to control the brightness of a lamp, such as a Cold Cathode Fluorescent Lamp (CCFL), that is coupled to an output from the piezoelectric transformer. Moreover, frequency modulation between the duty-cycle modulation frequency (some 200 Hz) and the resonant frequency may lead to sound generation in an audible frequency range (typically, 20-20,000 Hz). Since human hearing is less sensitive to random noise (as opposed to coherent tones), one solution to this problem is to further modulate the voltage signals 114. In particular, additional modulation of the voltage signals 114 may spread out the energy of the intermodulation products thereby reducing and/or eliminating human perception of the generated sound.

Figure 2:
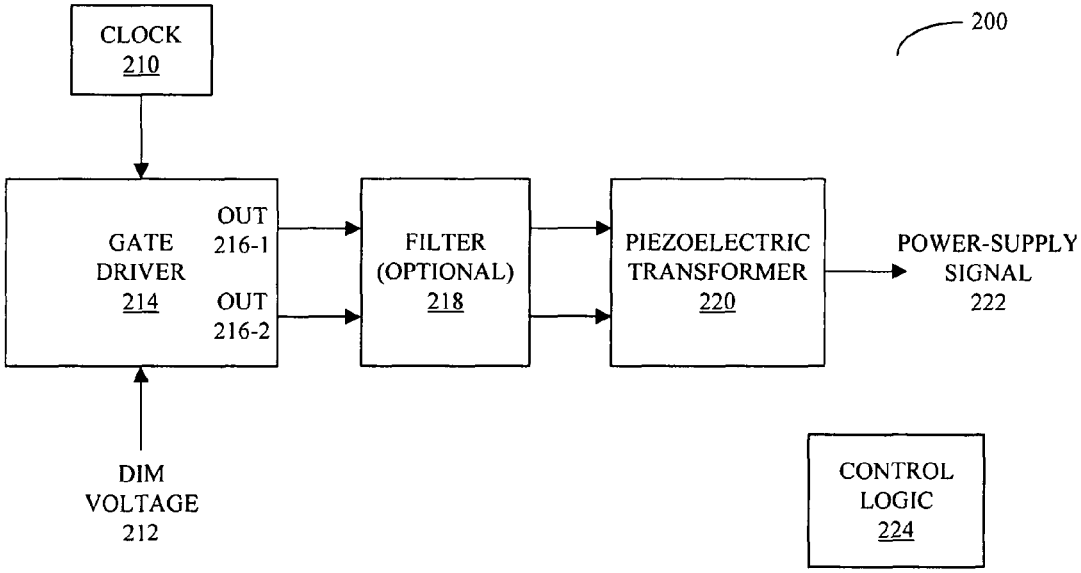
FIG. 2 is a block diagram illustrating a power-supply circuit in accordance with an embodiment of the present invention.

This is shown in FIG. 2, which presents a block diagram illustrating a power-supply circuit 200 in accordance with an embodiment of the present invention. In this power-supply circuit, a gate driver 214 generates output signals on outputs 216 based on one or more clock signals provided by clock 210. In some embodiments, the one or more clock signals have a fundamental frequency at or near the resonant frequency of piezoelectric transformer 220. However, in other embodiments the one or more clock signals are stepped up or down to a desired frequency, for example, using a phase-locked loop or a delay-locked loop. In an exemplary embodiment, the output signals have a fundamental frequency of 50 kHz.

The gate driver 214 may modulate the output signals based on a dim voltage 212. In an exemplary embodiment, the output signals are duty-cycle modulated based on the dim voltage 212 in 16-incremental steps. For example, for a dim voltage 212 of 3.3 V the output signals may not be duty-cycle modulated (i.e., the output signals may each have a duty cycle of 100%), while for a dim voltage 212 of 0.2 V the output signals may have the maximum modulation (i.e., the output signals may each have a duty cycle of 6.25%). Note that the duty-cycle modulation may be implemented using pulse-width modulation with a pulse period of 5 ms, i.e., a frequency of 200 Hz. Furthermore, in some embodiments the additional modulation may be implemented using frequency modulation, pulse-time modulation, and/or phase modulation.

Gate driver 214 may apply an additional modulation to the output signals to spread the energy associated with intermodulation products between the resonant frequency and the duty-cycle modulation frequency. For example, this additional modulation may randomly or pseudorandomly vary the pulse-width modulation period. Furthermore, in some embodiments the additional modulation uses a sequence of pulse-width modulated signals during a corresponding sequence of time intervals. Note that a given pulse-width modulated signal during a given time interval in the sequence of time intervals may have a pulse-width period that is determined using a pseudorandom sequence.

In an exemplary embodiment, the pulse-width modulation period is varied between 2.5 and 5 ms, i.e., frequencies of 200 and 400 Hz. Note that this range of periods may avoid interfering with a refresh rate of a display that is driven by a power-supply signal 222 output from the power-supply circuit 200. Furthermore, note that while this additional modulation does not cancel or eliminate the intermodulation products (which would impact the efficiency of the piezoelectric transformer 220), it does spread the harmonic energy over a larger range of frequencies, thereby reducing human perception of the resulting sound.

The output signals from the gate driver 214 may be optionally filtered using filter 218 and then coupled to the piezoelectric transformer 220. For example, the filter 218 may be a low-pass resistance-inductance filter, with an inductance of 22.0 μH and a resistance of 0.17Ω. Furthermore, in an exemplary embodiment the piezoelectric transformer 220 may have a resistance of 100Ω, an inductance of 8 mH, and a capacitance of 1.2 pF.

Moreover, the piezoelectric transformer 220 may generate the power-supply signal 222, which may be coupled to a light source (such as a CCFL) that drives a display (such as a LCD). Note that in some embodiments the additional modulation in the gate driver 214 may be chosen to maintain the overall duty cycle of the output signals, i.e., without impacting the brightness of the display. Furthermore, the duty cycle of the output signals from the gate driver 214 may be optionally adjusted to maintain uniform display brightness at low dim levels by compensating for efficiency losses due to transformer ringing.

In some embodiments, the power-supply circuit 200 may include control logic 224. This control logic may be used to select and/or adjust the resonant frequency of the output signals and/or the additional modulation. Note that this adjustment(s): may be performed during a calibration mode; may be performed after a time interval; and/or may be dynamic (i.e., performed continuously). Furthermore, the adjustment(s) may be based on a measured acoustic signal and/or measured mechanical transfer function, for example, based on the amount of sound produced by the piezoelectric transformer 220 in a range of frequencies (such as between 20-20,000 Hz) and/or a gain of the piezoelectric transformer 220.

Note that in some embodiments the power-supply circuit 200 includes fewer or additional components, two or more components are combined into a single component, and/or a position of one or more components may be changed. For example, in some embodiments an analog band-stop filter may be placed at an input to the piezoelectric transformer 220. In an exemplary embodiment, a twin-t notch filter with a center frequency of 3 kHz may be used. However, in order to prevent significant attenuation of the output signals, such a filter may have an input impedance that is much smaller than the input impedance of the piezoelectric transformer 220. Unfortunately, such a low impedance may load the gate driver 214 and may therefore waste a significant amount of power. While this design problem may be addressed using buffers having high input impedance, the buffers may increase the size, complexity, and/or power consumption of the power-supply circuit 200.

Therefore, in some embodiments an analog band-stop filter may be placed at the outputs 216 from the gate driver 214. High input impedance field effect transistors (FETs) at the outputs 216 and/or inputs to the optional filter 218 may allow the use of a high-impedance, low-power band-stop filter. However, this technique may filter some of the harmonics in the output signals, and the output signals may no longer correspond to either a fully-on or a fully-off state of the outputs 216. As a consequence, at certain times both output drivers in the gate driver 214 may be partially on, leading to 'shoot through' (where a near short is created through the FETs between the power supply and ground). Thus, such an analog filter may result in significant power consumption as well as attenuation of the output signals.

Figure 3:
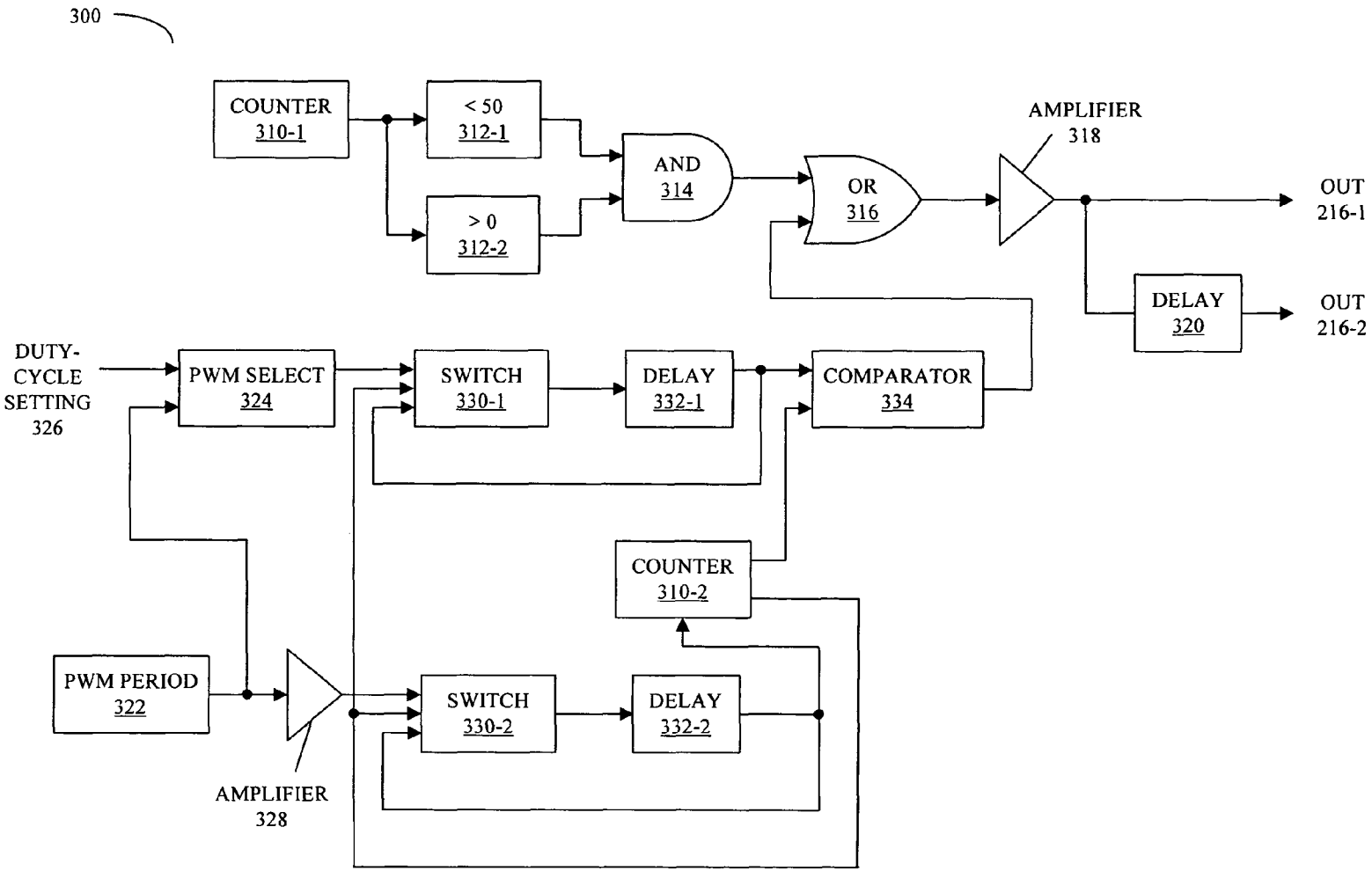
FIG. 3 is a block diagram illustrating a power-supply circuit in accordance with an embodiment of the present invention.

FIG. 3 presents a block diagram illustrating an exemplary power-supply circuit 300 (such as the gate driver 214 in FIG. 2) in accordance with an embodiment of the present invention. In this circuit, a counter 310-1, logical comparisons 312, and AND gate 314 provide a signal having a fundamental frequency of 50 kHz (which, once again, is henceforth referred to as the resonant frequency). Furthermore, a pulse-width-modulation-period circuit 322 provides a period for the pulse-width modulation (PWM), and PWM-select circuit 324 determines the pulse-width modulation based on the period and a duty-cycle setting 326. For example, the PWM-period circuit 322 may include a shift-register-sequence generator corresponding to a 32-bit maximum-length pseudorandom sequence. This generator may be used to generate pseudorandom numbers, where a given period is associated with a given pseudorandom number.

The power-supply circuit may vary the period during a sequence of time intervals. These intervals are generated using amplifier 328, switches 330, delays 332, counter 310-2, and comparator 334. Note that comparator 334 outputs a pulse-width modulated signal. Furthermore, OR gate 316 applies the resonant-frequency signal or the pulse-width modulated signal to amplifier 318, which provides a first output signal on output 216-1 and, after delay 320, a 180°-delayed output signal on output 216-2.

Thus, at the beginning of each pulse-width modulated period the time that the resonant-frequency signal is on and the total pulse-width modulation period are determined by the pseudorandom number generated by the PWM-period circuit 322. Furthermore, for each pulse-width modulation period, a new pseudorandom number is used. Note that in some embodiments the power-supply circuit 300 includes fewer or additional components, two or more components are combined into a single component, and/or a position of one or more components may be changed.

Figure 4:
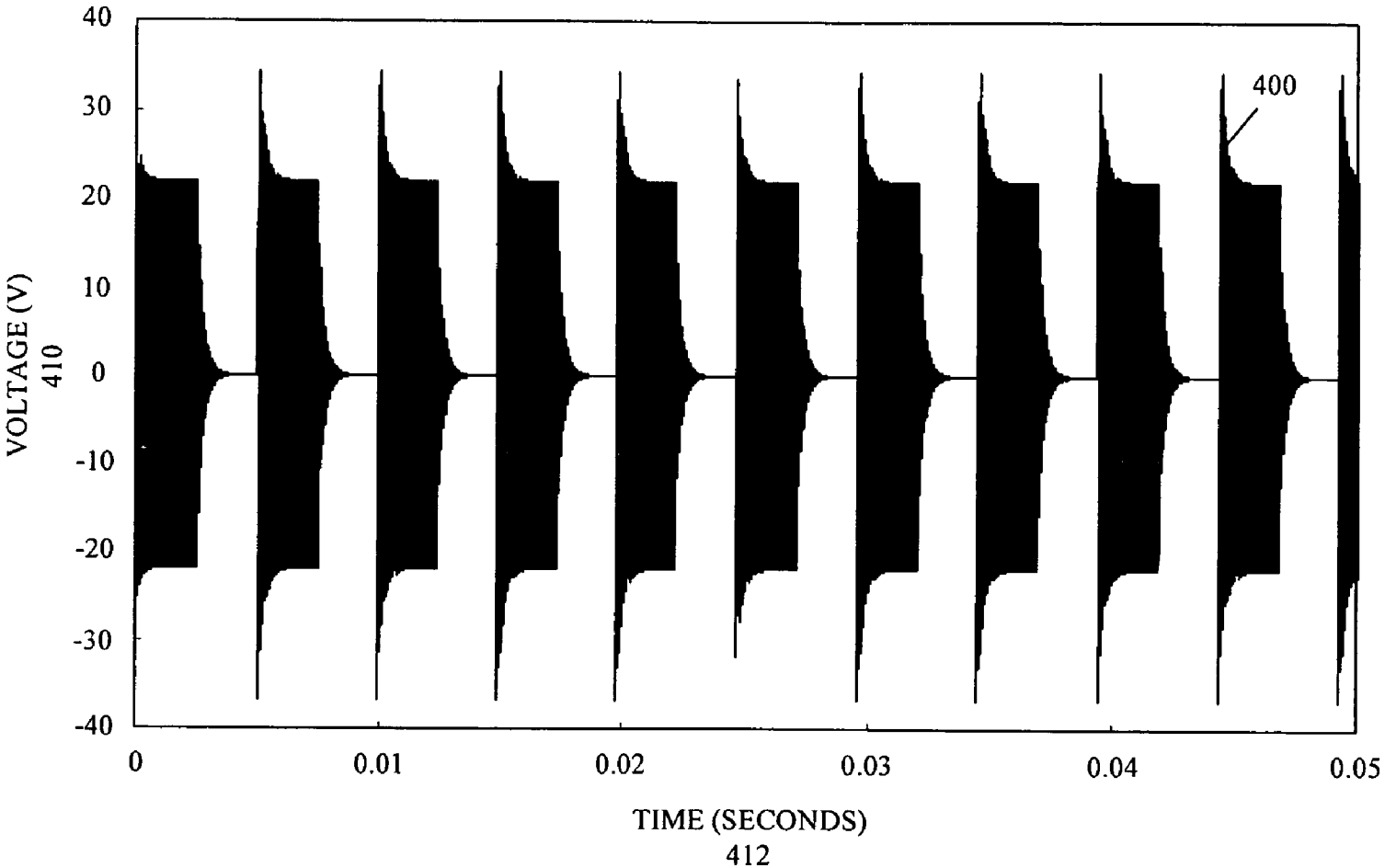
FIG. 4 is a block diagram illustrating a simulated modulated power-supply signal in accordance with an embodiment of the present invention.

We now describe simulations of the impact of the power-supply circuit 200 illustrated in FIG. 2. The results of the simulations are shown in FIG. 4, which presents a block diagram illustrating voltage 410 in Volts as a function of time 412 in seconds for a simulated modulated power-supply signal 400 in accordance with an embodiment of the present invention. This signal, which is at the input to the piezoelectric transformer 220 (FIG. 2), has a 50% duty-cycle modulation and does not include the additional modulation.

Figure 5:
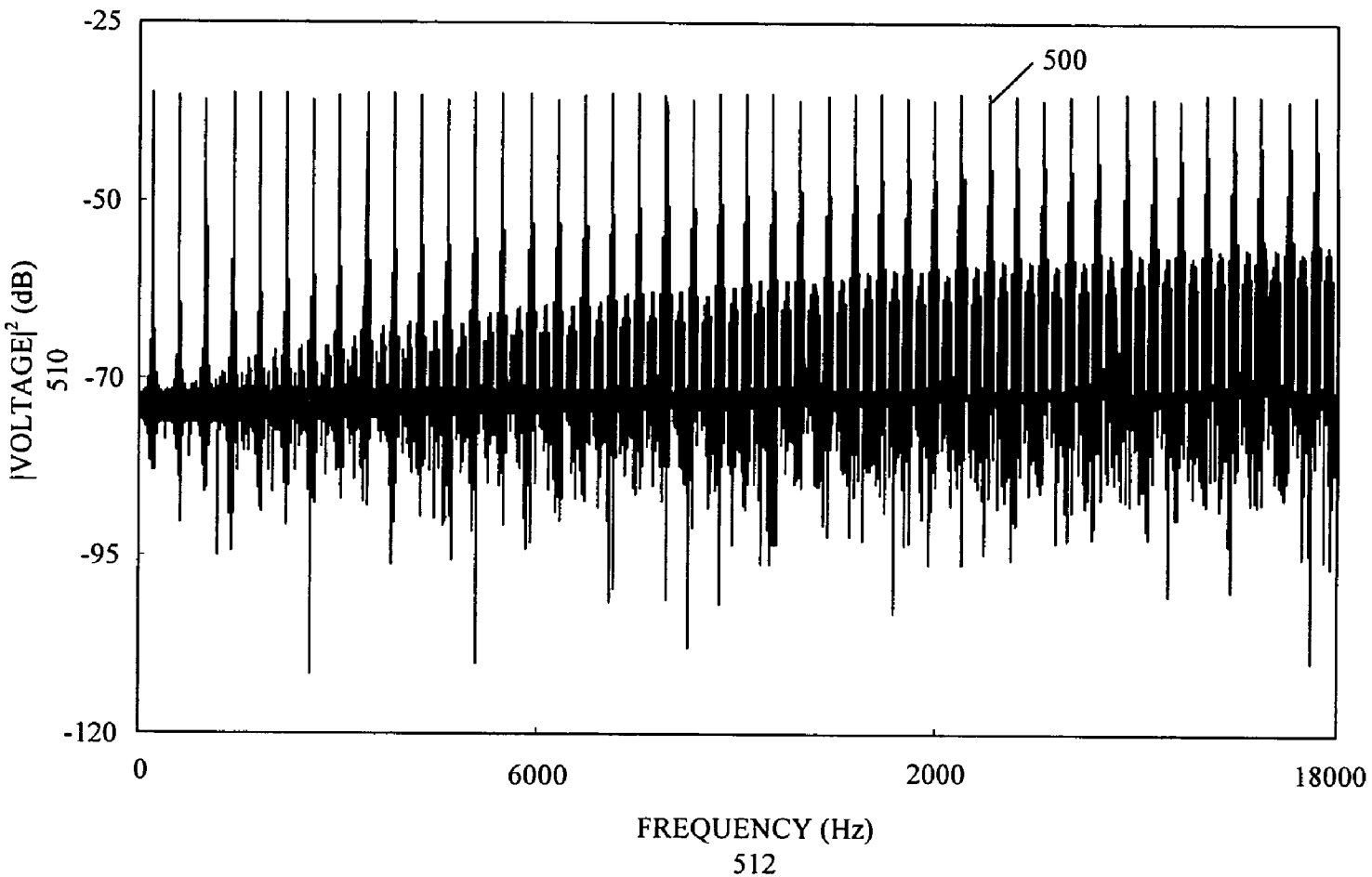
FIG. 5 is a block diagram illustrating a simulated frequency spectrum of a modulated power-supply signal in accordance with an embodiment of the present invention.

FIG. 5 presents a block diagram illustrating a simulated frequency spectrum 500 of the modulated power-supply signal 400 in accordance with an embodiment of the present invention. The frequency spectrum 500 shows a square magnitude 510 of the signal in dB as a function of frequency 512 in Hz. As expected, based on theoretical analysis, the frequency spectrum 500 includes harmonics at frequencies of $$f_1 \pm k \cdot f_2,$$

where $f_1$ is 50 kHz, $f_2$ is 200 Hz, and k is an odd integer. Note that the range of frequencies shown in FIG. 5 includes audible frequencies.

Figure 6:
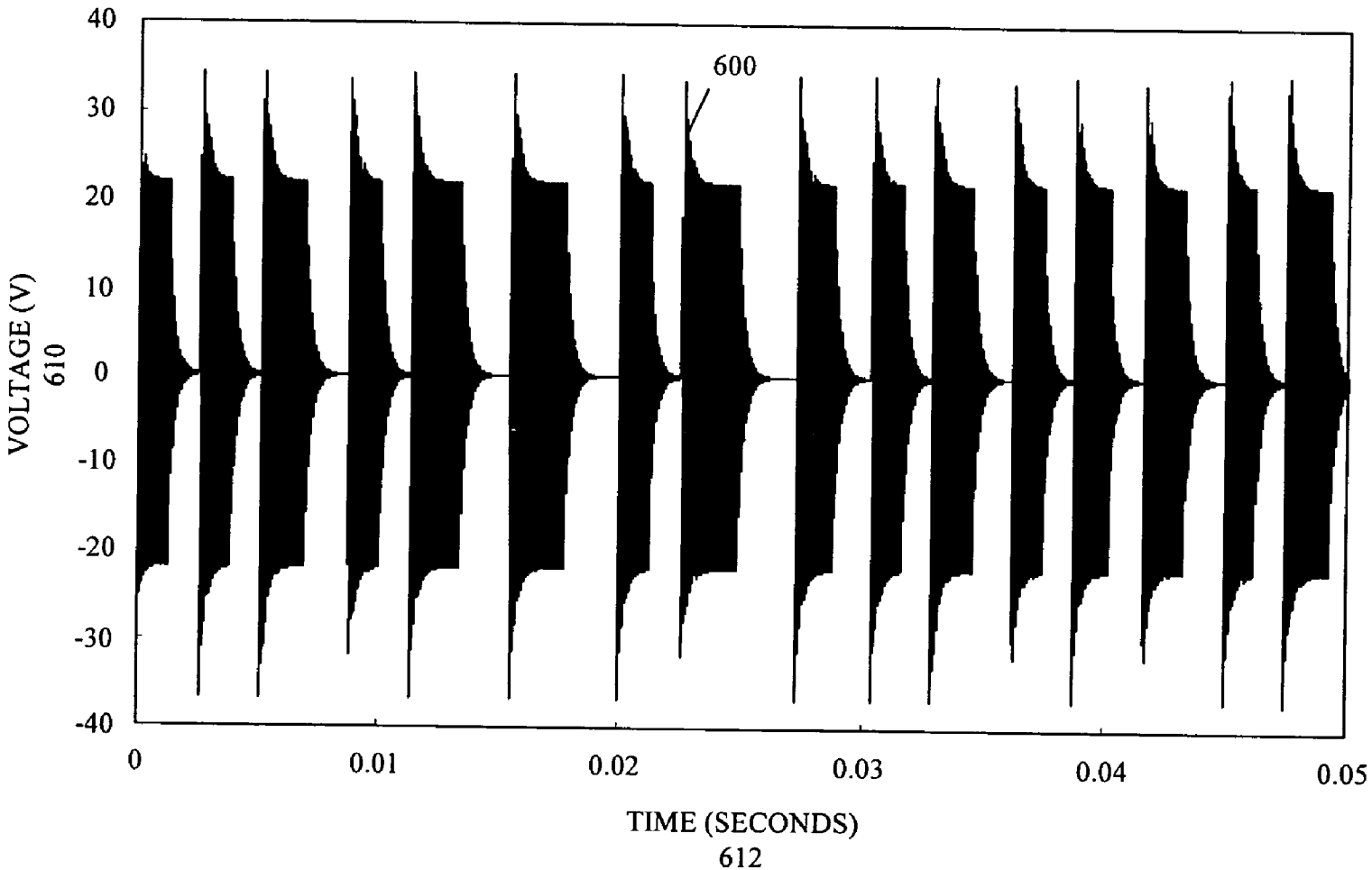
FIG. 6 is a block diagram illustrating a simulated modulated power-supply signal in accordance with an embodiment of the present invention.
Figure 7:
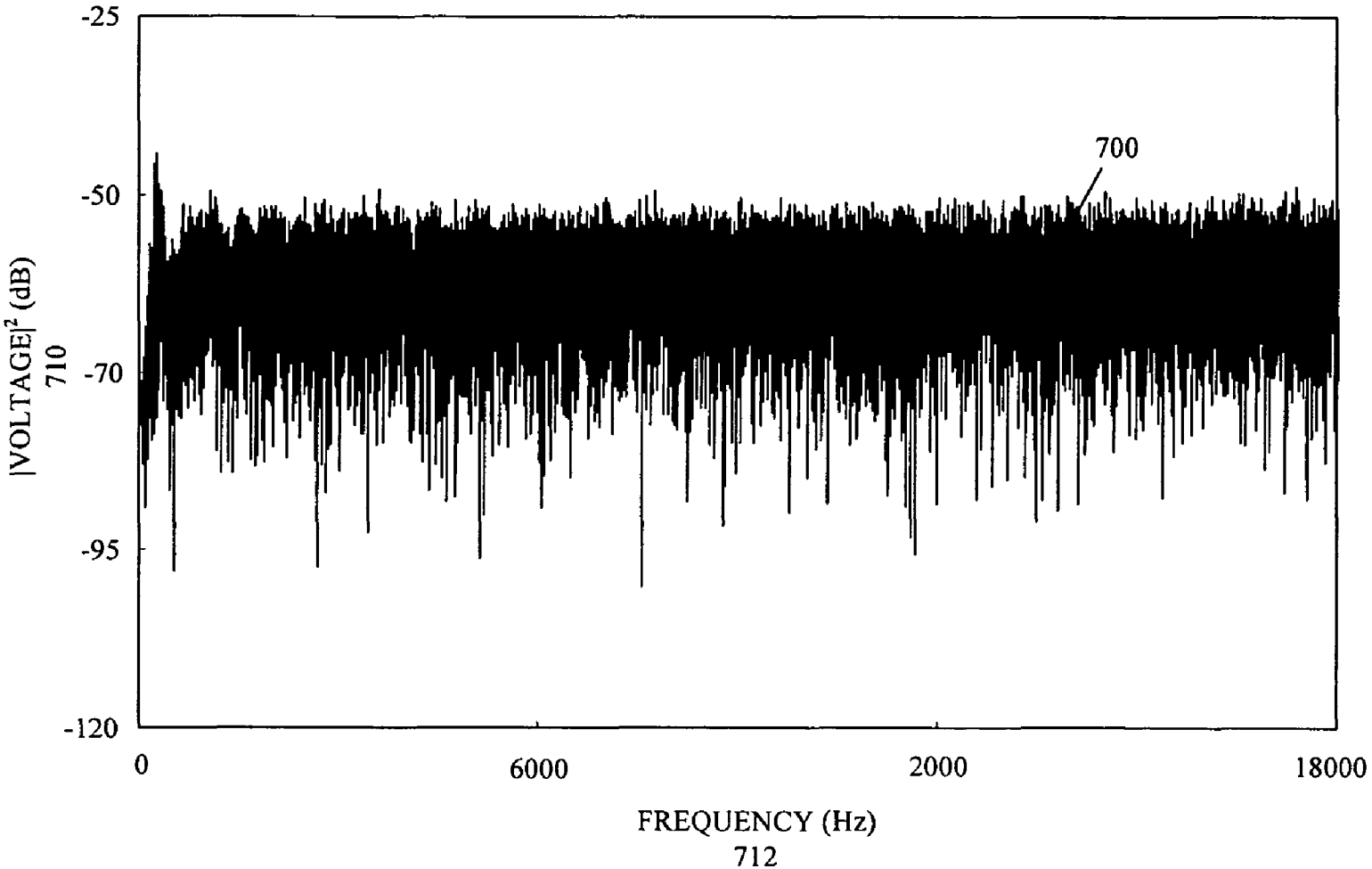
FIG. 7 is a block diagram illustrating a simulated frequency spectrum of a modulated power-supply signal in accordance with an embodiment of the present invention.

The impact of the additional modulation is shown in FIGS. 6 and 7. FIG. 6 presents a block diagram illustrating voltage 610 in Volts as a function of time 612 in seconds for a simulated modulated power-supply signal 600 in accordance with an embodiment of the present invention. This signal, which is at the input to the piezoelectric transformer 220 (FIG. 2), has a 50% duty-cycle modulation and a pulse-width modulation with a period that is varied between 2.5 and 5 ms for each period according to a number generated using a pseudorandom-sequence generator. As in FIG. 4, the time that the carrier frequency is enabled is equal to the time that it is disabled, i.e., the duty cycle is 50%. However, note that this time changes randomly or pseudorandomly between pulse-width modulation periods.

FIG. 7 presents a block diagram illustrating a simulated frequency spectrum 700 of the modulated power-supply signal 600 in accordance with an embodiment of the present invention. The frequency spectrum 700 shows a square magnitude 710 of the signal in dB as a function of frequency 712 in Hz. Note that by randomizing the pulse-width-modulation period the frequency spikes are now spread out. Indeed, in the region around 3 kHz the amplitude of the spikes is reduced by more than 10 dB. As a consequence, the white noise generated by randomizing the pulse-width-modulation period may be significantly less annoying to users than the harmonics that are produced when a fixed pulse-width-modulation period is used. Furthermore, by randomizing the pulse-width-modulation period, the audible noise produced may no longer depend on the duty-cycle modulation, i.e., the brightness of the display.

Figure 8:
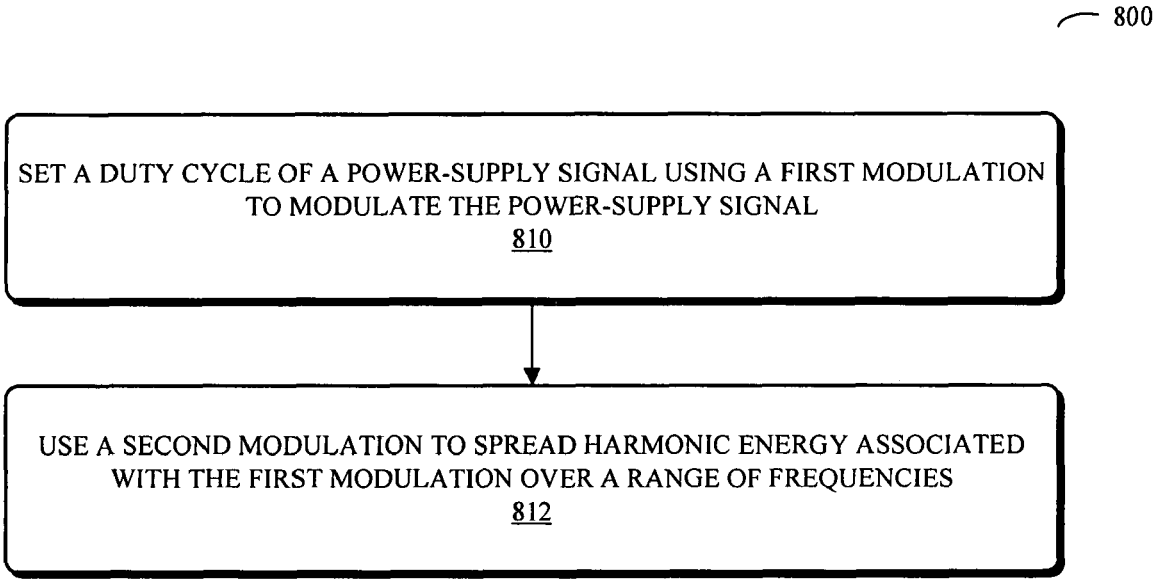
FIG. 8 is a flowchart illustrating a process for generating a power-supply signal in accordance with an embodiment of the present invention.

We now discuss methods for generating a power-supply signal. FIG. 8 presents a flowchart illustrating a process 800 for generating a power-supply signal in accordance with an embodiment of the present invention. During this process, a circuit sets a duty cycle of a power-supply signal using a first modulation to modulate the power-supply signal (810). Then, the circuit uses a second modulation to spread harmonic energy associated with the first modulation over a range of frequencies (812). Note that in some embodiments of the process 800 there may be additional or fewer operations, the order of the operations may be changed, and two or more operations may be combined into a single operation.

Figure 9:
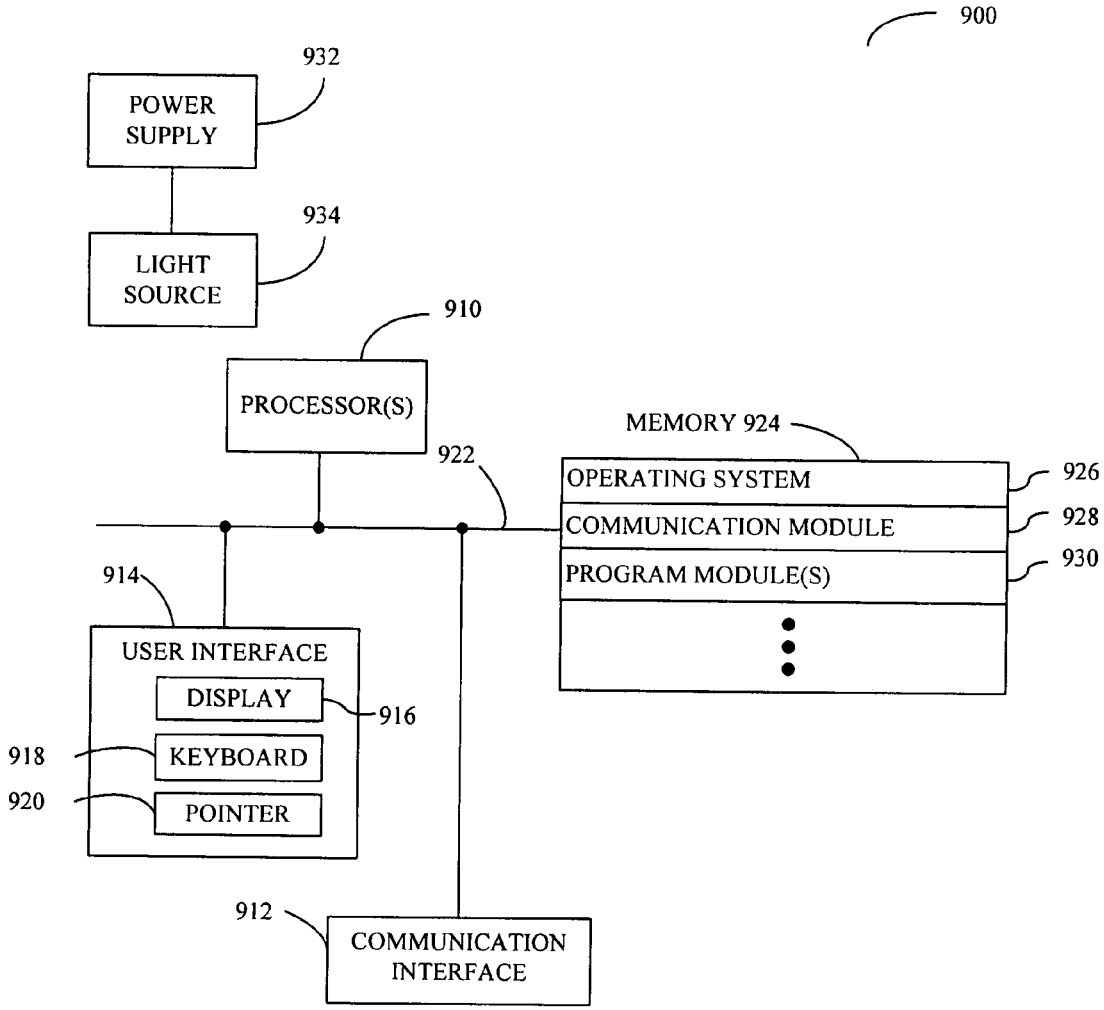
FIG. 9 is a block diagram illustrating a computer system in accordance with an embodiment of the present invention.

We now described computer systems that may include embodiments of the power-supply circuit and/or which may implement embodiments of the process. FIG. 9 presents a block diagram illustrating a computer system 900 in accordance with an embodiment of the present invention. The computer system 900 includes one or more processors 910, a communication interface 912, a user interface 914, and one or more signal lines 922 coupling these components together. Note that the one or more processing units 910 may support parallel processing and/or multi-threaded operation, the communication interface 912 may have a persistent communication connection, and the one or more signal lines 922 may constitute a communication bus. Moreover, the user interface 914 may include a display 916, a keyboard 918, and/or a pointer 920, such as a mouse.

Memory 924 in the computer system 900 may include volatile memory and/or non-volatile memory. More specifically, memory 924 may include ROM, RAM, EPROM, EEPROM, FLASH, one or more smart cards, one or more magnetic disc storage devices, and/or one or more optical storage devices. Memory 924 may store an operating system 926 that includes procedures (or a set of instructions) for handling various basic system services for performing hardware dependent tasks. The memory 924 may also store procedures (or a set of instructions) in a communication module 928. The communication procedures may be used for communicating with one or more computers and/or servers, including computers and/or servers that are remotely located with respect to the computer system 900. Memory 924 may also include multiple program modules (or a set of instructions).

Note that instructions in the various modules in the memory 924 may be implemented in a high-level procedural language, an object-oriented programming language, and/or in an assembly or machine language. The programming language may be compiled or interpreted, i.e, configurable or configured to be executed by the one or more processing units 910.

Furthermore, the computer system 900 may include a power supply 932 that provides a power-supply signal to a light source 934. This light source may illuminate the display 916. Furthermore, the power supply 932 may include one or more power-supply circuits as described previously. Note that in some embodiments the power supply 932 may be coupled to a battery (not shown). Also note that in some embodiments the light source 934 may be a CCFL and the display 916 may be a LCD.

Although the computer system 900 is illustrated as having a number of discrete components, FIG. 9 is intended to be a functional description of the various features that may be present in the computer system 900 rather than as a structural schematic of the embodiments described herein. In practice, and as recognized by those of ordinary skill in the art, the functions of the computer system 900 may be distributed over a large number of servers or computers, with various groups of the servers or computers performing particular subsets of the functions. In some embodiments, some or all of the functionality of the computer system 900 may be implemented in one or more ASICs and/or one or more digital signal processors DSPs.

The computer system 900 may include fewer components or additional components, two or more components may be combined into a single component, and/or a position of one or more components may be changed. In some embodiments the functionality of the computer system 900 may be implemented more in hardware and less in software, or less in hardware and more in software, as is known in the art.

The foregoing descriptions of embodiments of the present invention have been presented for purposes of illustration and description only. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A power-supply circuit, comprising:

an input node configured to receive a power-supply signal;

an output node configured to output a modulated power-supply signal; and a modulation mechanism coupled between the input node and the output node, wherein the modulation mechanism is configured to modulate the power-supply signal to produce the modulated power-supply signal;

wherein the modulation mechanism is configured to modulate the power-supply signal using both a first modulation and a second modulation;

wherein the first modulation includes a duty-cycle modulation; and wherein the second modulation spreads harmonic energy associated with the first modulation over a range of frequencies.

2. The power-supply circuit of claim 1, wherein the power-supply signal is associated with a piezoelectric transformer.

3. The power-supply circuit of claim 1, wherein the second modulation includes frequency modulation.

4. The power-supply circuit of claim 1, wherein the second modulation includes phase modulation.

5. The power-supply circuit of claim 1, wherein the second modulation is based on a look-up table.

6. The power-supply circuit of claim 1, wherein the second modulation includes pulse-time modulation.

7. The power-supply circuit of claim 1, wherein the second modulation reduces perception of sound associated with modulation of the power-supply signal using the first modulation.

8. The power-supply circuit of claim 1, wherein the second modulation is dynamically adjusted.

9. The power-supply circuit of claim 1, wherein a duty cycle in the first modulation determines an average light intensity of a light source coupled to the power-supply circuit.

10. The power-supply circuit of claim 9, wherein the light source is a fluorescent lamp.

11. The power-supply circuit of claim 1, wherein the power-supply circuit is included in a computing device.

12. The power-supply circuit of claim 11, wherein the computing device includes a display that is configured to be illuminated by a light source coupled to the power-supply circuit.

13. The power-supply circuit of claim 1, wherein the second modulation includes pulse-width modulation.

14. The power-supply circuit of claim 13, wherein a pulse-width period of the second modulation is pseudorandomly varied.

15. The power-supply circuit of claim 1, wherein the second modulation is modified during a calibration mode.

16. The power-supply circuit of claim 15, wherein the modification is based on a measured acoustic signal.

17. The power-supply circuit of claim 15, wherein the modification is based on a mechanical transfer function.

18. The power-supply circuit of claim 1, wherein the second modulation uses a sequence of pulse-width modulated signals during a corresponding sequence of time intervals; and wherein a given pulse-width modulated signal during a given time interval in the sequence of time intervals has a pulse-width period that is determined using a pseudo-random sequence.

19. The power-supply circuit of claim 18, wherein the modulation during the given time interval has a same duty cycle as in the duty-cycle modulation.

20. The power-supply circuit of claim 18, wherein the modulation during the given time interval adjusts the duty cycle to compensate for circuit inefficiencies.

21. The power-supply circuit of claim 18, wherein the pulse-width period is further determined to avoid interfering with a refresh frequency of a display that is configured to be illuminated by a light source that is coupled to the power-supply circuit.

22. A computing system, comprising:

a power-supply;

a light source coupled to the power supply; and a display configured to be illuminated by the light source, wherein the power-supply includes a modulation mechanism that is configured to modulate a power-supply signal using a first modulation and a second modulation;

wherein the first modulation includes a duty-cycle modulation; and wherein the second modulation spreads harmonic energy associated with the first modulation over a range of frequencies.

23. A method for generating a power-supply signal, comprising:

setting a duty cycle of the power-supply signal using a first modulation to modulate the power-supply signal; and using a second modulation to spread harmonic energy associated with the first modulation over a range of frequencies.

* * * * *